US006817282B2

(12) United States Patent
Lappat et al.

(10) Patent No.: US 6,817,282 B2
(45) Date of Patent: Nov. 16, 2004

(54) COOKER

(75) Inventors: Hans Lappat, Garching/Alz (DE); Helmut Uglorz, Steinheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 50 days.

(21) Appl. No.: 10/454,200

(22) Filed: Jun. 4, 2003

(65) Prior Publication Data

US 2003/0213372 A1 Nov. 20, 2003

Related U.S. Application Data

(63) Continuation of application No. PCT/EP01/13282, filed on Nov. 16, 2001.

(30) Foreign Application Priority Data

Dec. 4, 2000 (DE) ..... 100 60 155

(51) Int. Cl.[7] ..... A23L 1/00; F24C 15/00; F24C 15/32; F24C 7/02; H05B 6/64

(52) U.S. Cl. ..... 99/330; 99/337; 99/342; 99/417; 99/467; 99/472; 99/476; 99/516; 126/21 A; 126/299 R; 219/396; 219/400

(58) Field of Search ..... 99/330, 337, 340, 99/339, 342, 467–473, 474–476, 417, 516; 126/20, 299 R, 21 A, 369, 21 R; 219/400, 401, 385, 396, 492, 393, 757, 707, 681, 682, 683; 239/461, 509; 392/492, 360, 400, 393, 399, 394; 426/523, 509–511

(56) References Cited

U.S. PATENT DOCUMENTS

| | | | | | |
|---|---|---|---|---|---|
| 3,889,099 | A | * | 6/1975 | Nuss | 219/393 |
| 4,110,916 | A | * | 9/1978 | Bemrose | 34/197 |
| 4,503,760 | A | * | 3/1985 | Pryputsch et al. | 99/447 |
| 4,823,766 | A | * | 4/1989 | Violi | 126/20 |
| 5,029,519 | A | * | 7/1991 | Boyen | 99/341 |
| 5,272,963 | A | * | 12/1993 | Del Fabbro | 99/468 |
| 5,423,248 | A | * | 6/1995 | Smith et al. | 99/443 C |
| 5,481,962 | A | * | 1/1996 | Tedesco | 99/323.4 |
| 5,499,577 | A | * | 3/1996 | Tommasini | 99/476 |
| 5,500,508 | A | | 3/1996 | Gerl | |
| 5,503,061 | A | * | 4/1996 | Hopkins | 99/357 |
| 5,615,603 | A | * | 4/1997 | Polin | 99/331 |
| 5,690,020 | A | * | 11/1997 | Kitani et al. | 99/470 |
| 5,694,835 | A | * | 12/1997 | Mangina | 99/468 |
| 6,070,517 | A | | 6/2000 | Helm | |

FOREIGN PATENT DOCUMENTS

| | | |
|---|---|---|
| EP | 0 322 735 A2 | 7/1989 |
| EP | 0 598 211 B1 | 5/1994 |
| EP | 1 050 718 A2 | 11/2000 |

* cited by examiner

*Primary Examiner*—Timothy F. Simone
(74) *Attorney, Agent, or Firm*—Laurence A. Greenberg; Werner H. Stemer; Ralph E. Locher

(57) ABSTRACT

A cooking device includes a cooking chamber having at least one vapor opening through which the vapor from the cooking chamber, when in operation, conveyed by a conveyor, and at least one opening that can absorb external air, particularly with the aid of the conveyor. The invention also relates to a device that can be used to adjust the amount of external air and a vapor stream from the cooking chamber according to the external air.

19 Claims, 5 Drawing Sheets

COOKER

CROSS-REFERENCE TO RELATED APPLICATION

This application is a continuation of copending International Application No. PCT/EP01/13282, filed Nov. 16, 2001, which designated the United States and was not published in English.

BACKGROUND OF THE INVENTION

Field of the Invention

The invention is based on a cooker having a cooking space having at least one vapor opening through which vapor produced during operation can be fed as a vapor stream.

European Patent Application 0 598 211 B1, corresponding to U.S. Pat. No. 5,500,508 to Gerl, discloses a cooker or an oven having a vapor opening that is provided in an oven wall and through which, during cooking, a vapor produced can be fed outward from an oven muffle by a cooling-air fan. A flow cross-section of a flow channel adjoining the vapor opening can be adjusted automatically by a restrictor. The restrictor is adjusted in dependence on a vapor temperature. The restrictor forms a large flow cross-section in the case of a low level of heat developed in the oven muffle, and it forms a small flow cross-section in the case of a pronounced level of heat developed. In addition to the vapor, the cooling-air fan takes in cooling air from the surroundings of the oven, through an opening, and feeds this outward, through the flow channel, together with the vapor.

SUMMARY OF THE INVENTION

It is accordingly an object of the invention to provide a cooker that overcomes the hereinafore-mentioned disadvantages of the heretofore-known devices of this general type and that is not susceptible to contamination and that exhibits a constant behavior throughout its service life.

With the foregoing and other objects in view, there is provided, in accordance with the invention, a cooker, including a feed device, a cooking enclosure communicating with the feed device, the cooking enclosure defining a cooking space, at least one vapor opening through which vapor produced during operation of the cooker can be fed as a vapor stream from the cooking space by the feed device, and at least one opening through which extraneous air can be taken in by the feed device, and an adjustment device adjusting a quantity of the extraneous air and, through the quantity of extraneous air, the vapor stream from the cooking space.

The invention is based on a cooker having a cooking space that has at least one vapor opening, through which vapor produced during operation can be fed from the cooking space by a feed device, and having at least one opening, through which extraneous air can be taken in, in particular, by the feed device.

It is proposed that a device can be used to adjust the quantity of extraneous air and, through the quantity of extraneous air, a vapor stream from the cooking space. Advantageous vapor management can be achieved straightforwardly in design terms, and measures that adjust the vapor stream, for example, a restrictor or a closure, are disposed in an at least largely contaminant-free region that is separated from the vapor stream. It is possible to avoid high-outlay cleaning operations and to achieve a long service life and constant behavior, to be precise, in particular, in respect of the vapor management. The extraneous air may, advantageously, be utilized, in addition, as cooling air, and it is possible to do away with a separate cooling-air supply. Furthermore, condensing out can be avoided as a result of the extraneous air.

In terms of flow, various possibilities are conceivable for configuring the opening, and/or configuring the channel system, such that a device can be used to adjust the quantity of extraneous air taken in and, through the quantity of extraneous air taken in, the quantity of vapor extracted or carried, for example, it is basically possible, in accordance with the principle of an atomizer or of a jet pump, for extraneous air or fresh air to be taken in, etc. through a first channel and for vapor to be taken in through a second channel. The extraneous air is, advantageously, taken in by the vapor-feed measures, but may also be taken in, in principle, by a separate feed device. Configurations that are particularly straightforward and cost-effective in terms of flow may be achieved if the opening is disposed, in terms of flow, upstream of the feed device. It is possible for the vapor and the extraneous air to be supplied to the feed device, in terms of flow, in two separate channels and also to be carried further by the feed device, in terms of flow, in two separate channels. If the channels, however, are for the most part combined, it is possible to reduce the number of components, the installation space and costs. In particular, a channel advantageously adjoins the vapor opening, and the opening through which the extraneous air can be taken in is disposed in the channel, in terms of flow, between the vapor opening and the feed device.

In order, nevertheless, to avoid contamination of the opening and/or of the device by the vapor stream, the opening is advantageously disposed outside the vapor stream in a dead space of the channel, and/or moveable devices and, in particular, guide elements of moveable measures of the device through which the quantity of extraneous air can be adjusted are advantageously disposed outside the channel. It is further proposed that the channel has at least one flow-deflecting device, and the opening is disposed in the region of the deflecting device, in a direction, as seen counter to the flow direction, downstream of the deflecting device, and/or that a further channel element is disposed in the channel upstream of the opening, as seen in the flow direction of the extraneous air, and a moveable measures of the device is disposed upstream of the channel element, as seen in the flow direction of the extraneous air. Further shielding against the vapor stream can be achieved through the channel element.

If the channel element is formed by a component that is separate from the channel, the channel element and the device may be configured as a subassembly. It is possible for cookers simply to be offered optionally with or without the channel element and the device according to the invention, and for the subassembly to be cost-effectively produced separately in the necessary numbers and to be checked separately in terms of functioning. In principle, however, it is also conceivable for the channel element to be integrally formed, at least in part, on the channel through which the vapor is carried out of the cooking space. As a result, it is additionally possible to reduce the number of components.

If the channel has a labyrinth, it is possible, on one hand, to achieve flow calming and, on the other hand, for dirt to be separated off, with the result that components and regions that adjoin the labyrinth in terms of flow, for example, the feed device, are protected against direct contamination.

The device may be configured with one or more pivotably mounted closures and/or with one or more closures that are guided such that they can be displaced in a translatory manner, it being possible for closures that are mounted such that they can be displaced in a translatory manner to be configured in a particularly cost-effective and straightforward manner in terms of design. Furthermore, other flow-regulating measures that appear expedient to the person skilled in the art, for example, restrictors, etc., are also conceivable.

In accordance with another feature of the invention, the device has at least one actuator. By the actuator, it is possible to achieve easy operation and, in particular, to construct an automated control and/or regulator, to be precise, in particular, in that at least one operating parameter can be sensed through a sensor unit, and the vapor stream can be controlled and/or regulated automatically, in dependence on the operating parameter, by a unit. In dependence on the food that is to be cooked and/or on the operator's requirements, various modes of operation can be set, for example, it is possible, with a low level of vapor removal, to achieve a particularly energy-saving mode of operation, and a constant pressure and/or a constant air humidity can be adjusted in the cooking space, etc.

The actuator may be configured hydraulically, pneumatically, electrically, and/or electromagnetically and may be formed, for example, by a lifting magnet, an electric motor, and/or by an element that expands or shortens, etc. in dependence on a temperature and/or voltage that is present. It would, basically, also be possible for parts of the device to be formed, in particular, from bimetal, for example, a closure itself or a component that actuates a closure. In addition to, or instead of, an actuator, it is further conceivable for the device to be actuated manually by an operator, for example, through a lever mechanism or through a Bowden cable, etc.

In accordance with a further feature of the invention, there is provided a catalyst disposed in the channel in a region of the vapor opening.

With the objects of the invention in view, there is also provided a cooker, including a feeding means, a cooking enclosure communicating with the feeding means, the cooking enclosure defining a cooking space, at least one vapor opening through which vapor produced during operation of the cooker can be fed as a vapor stream from the cooking space by the feeding means, and at least one opening through which extraneous air can be taken in by the feeding means, and an adjustment device adjusting a quantity of the extraneous air and, through the quantity of extraneous air, the vapor stream from the cooking space.

With the objects of the invention in view, there is also provided a cooker, including a gas-feeding device, and a housing defining, a cooking space fluidically connected to the gas-feeding device for supplying a gas at least to a portion of the cooking space, at least one vapor opening through which vapor produced during operation of the cooker can be fed as a vapor stream from the cooking space by the gas-feeding device, at least one opening through which air from the environment can be taken into the cooking space by the gas-feeding device, and an adjustment device fluidically connected to the cooking space and to the at least one opening for adjusting a quantity of the air and, dependent upon the quantity of air adjusted, for also adjusting a quantity of the vapor stream from the cooking space. Preferably, the gas-feeding device is an air-feeding device.

The device according to the invention can be used in various cookers that appear expedient to the person skilled in the art, for example, in a microwave oven, etc., but particularly advantageously in an oven in which it is possible to achieve a high level of energy reduction by way of vapor management and new modes of operation that are of interest.

Other features that are considered as characteristic for the invention are set forth in the appended claims.

Although the invention is illustrated and described herein as embodied in a cooker, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
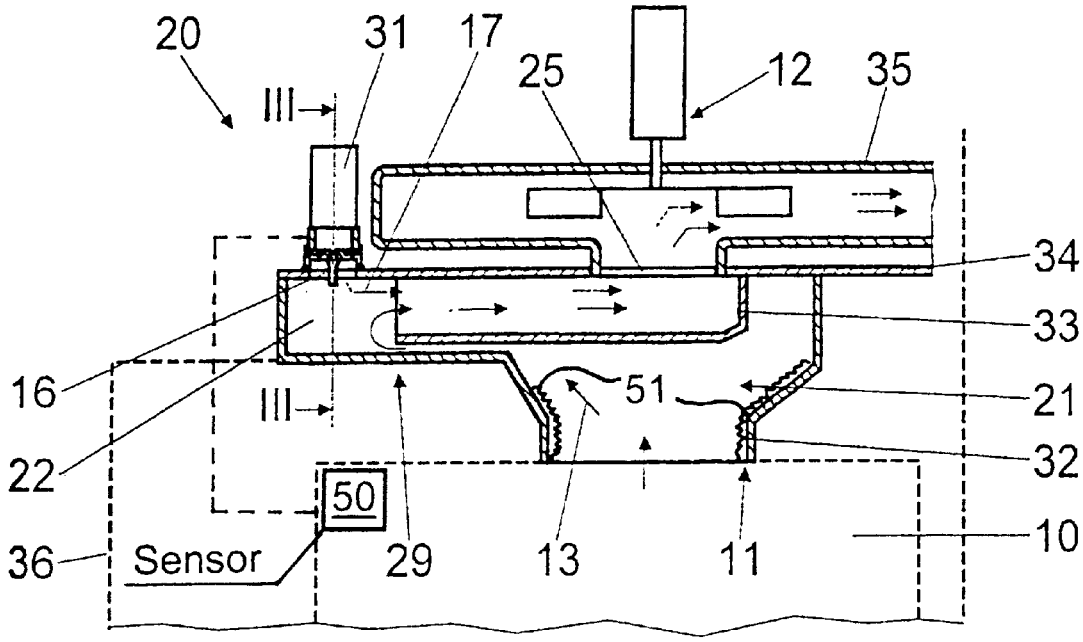
FIG. 1 is a fragmentary, cross-sectional view of an oven according to the invention.
Figure 2:
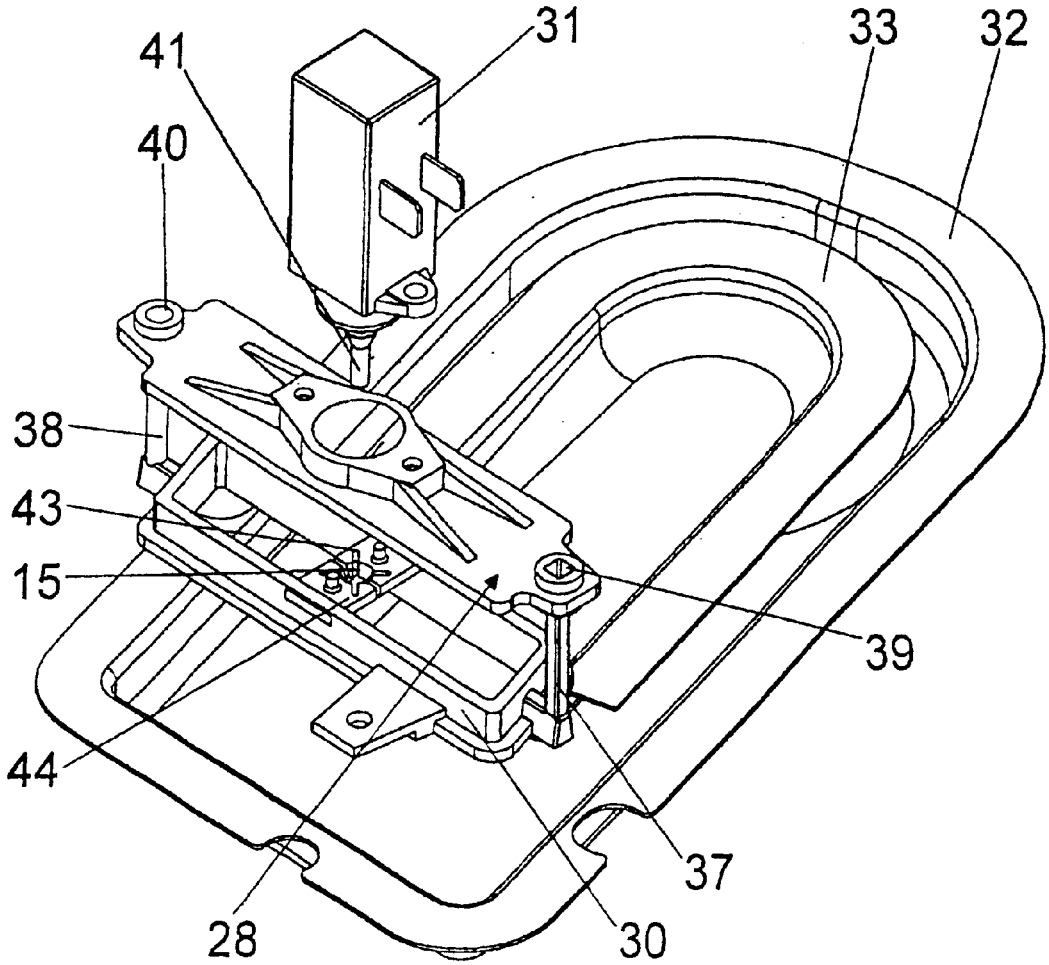
FIG. 2 is a perspective view from above the oven of FIG. 1 in a dismantled state.

Referring now to the figures of the drawings in detail and first, particularly to FIG. 1 thereof, there is shown a schematically illustrated oven with a cooking space 10 that is disposed in a housing 36 and has a vapor opening 11, through which vapor 13 can be fed outward, by a fan 12, during cooking from the cooking space 10 into a channel 21, and from the channel 21 through oven-door openings (not illustrated specifically). The channel 21 is formed by two tray-like sheet-metal plates 32, 33, a sheet-metal base plate 34, and a top channel element 35 made of sheet metal (FIG. 2). The sheet-metal base plate 34 is not illustrated in FIG. 2. The bottom sheet-metal plate 32 is of funnel-like configuration in relation to the vapor opening 11 and is fastened on the sheet-metal base plate 34 by way of its top side. The second sheet-metal plate 33 is disposed within the tray-like region of the first sheet-metal plate 32, is of open configuration on its longitudinally oriented end side directed away from the fan 12, and is fastened, by way of a top side, on the sheet-metal base plate 34, beneath an opening 25 of the sheet-metal base plate 34. The second sheet-metal plate 33 forms a kind of labyrinth in the channel 21. Above the opening 25 in the sheet-metal base plate 34, an impeller of the fan 12 is disposed within the channel element 35, which leads to the openings in the oven door.

By the fan 12, furthermore, it is possible for extraneous air 17 to be taken in through an opening 16 in the sheet-metal base plate 34, it being possible, according to the invention, to use a device 20 to adjust the quantity of extraneous air and, through the quantity of extraneous air, a vapor stream from the cooking space 10 (FIG. 1). The opening 16 is disposed in the channel 21 in a region of a flow-deflecting device or means 29, produced by the second sheet-metal plate 33, in a direction, as seen counter to the flow direction, downstream of the flow-deflecting device 29 and in a dead space 22 of the channel 21, in terms of flow, between the vapor opening 11 and the fan 12. A catalyst 51 can be disposed in the channel 21 near the vapor opening 11.

A further channel element 30 is disposed upstream of the opening 16, as seen in the flow direction of the extraneous air 17, and is formed by a plastic component that is separate from the channel 21. A closure device or means 28 that is guided such that it can be displaced in a translatory manner is disposed upstream of the channel element 30, as seen in the flow direction of the extraneous air 17. The channel element 30 is adjoined by a round and a square guide bolt 37, 38, through which the closure device 28 is guided by way of corresponding integrally formed guide openings 39, 40. Incorrect installation of the closure device 28 can be reliably avoided by the different cross-sectional surfaces of the guide bolts 37, 38 and of the guide openings 39, 40. The guide bolts 37, 38 and the guide openings 39, 40 are disposed outside the channel 21 and are, thus, reliably protected against contamination by the vapor 13.

A lifting actuator 31 with a thermocouple is screwed onto a reinforced region of the closure device 28, the thermocouple expanding or shortening in dependence on an applied voltage and a thereby establishing temperature. During installation, the lifting actuator 31 is latched, by way of its armature 41 and an annular groove 42 integrally formed thereon, into a bearing location 15 formed by two plates 43, 44 integrally formed on the channel element 30 (FIG. 2). The plates 43, 44 each extend halfway over the channel element 30 and, during the installation of the lifting actuator 31, may be deflected elastically in the flow direction of the extraneous air 17. To make it possible for the armature 41 to be latched in easily, the armature 41, following the groove 42, tapers conically in the direction of its free end.

Figure 3:
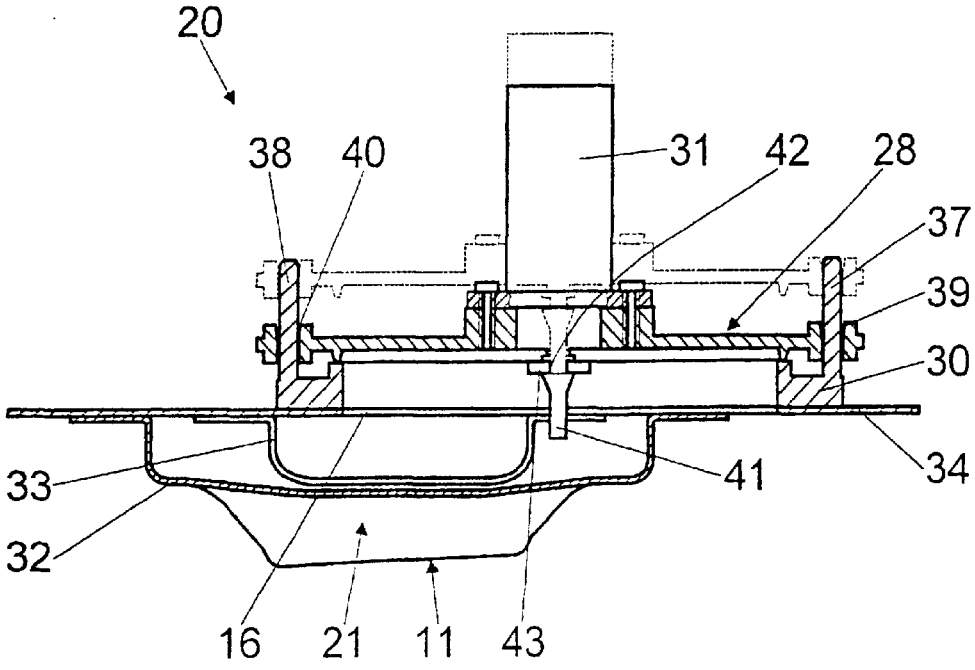
FIG. 3 a fragmentary, cross-sectional view of a section of the oven of FIG. 1 along line III—III.

If a voltage is applied to the lifting actuator 31, the thermocouple expands and the closure device 28 and the lifting actuator 31 itself lift off from the channel element 30. As a result, by the fan 12, extraneous air 17 can be taken in through the opening 16 and the vapor stream from the cooking space 10 can be reduced. Dashed lines are used in FIG. 3 to illustrate the closure device 28 in its open position. If the power supply to the lifting actuator 31 is interrupted, the thermocouple shortens and the closure device 28 and the lifting actuator 31 are lowered onto the channel element 30, and the opening 16 is closed. A supply of extraneous air is interrupted and the vapor stream from the cooking space 10 is increased. In addition to controlling the quantity of extraneous air, it is also conceivable, in principle, to use a fan, of which the suction power can be controlled in a stepless or stepwise manner.

To carry out automated control and/or regulation, at least one operating parameter can be sensed through a sensor unit 50, and the vapor stream can be controlled and/or regulated automatically, in dependence on the operating parameter.

Figure 4:
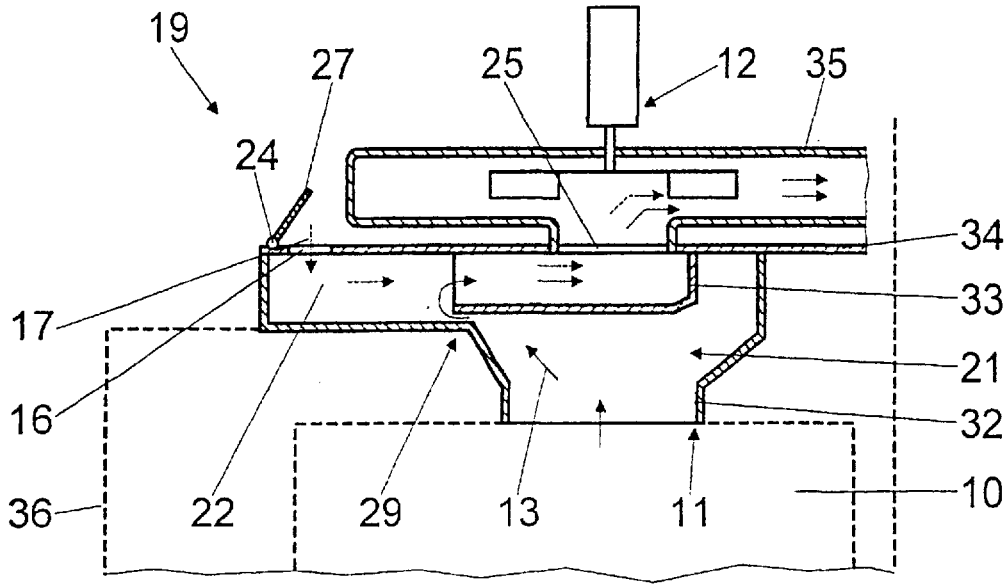
FIG. 4 is a fragmentary, cross-sectional view of an alternative embodiment of the oven of FIG. 1 with a swing-action closure.
Figure 5:
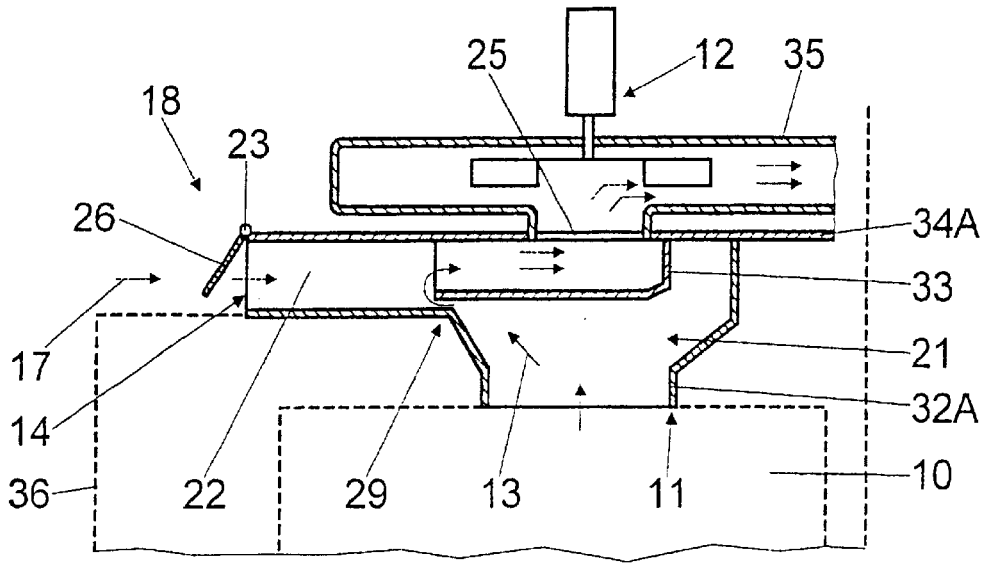
FIG. 5 is a fragmentary, cross-sectional view of an alternative embodiment of the closure of FIG. 4.

FIGS. 4 and 5 illustrate alternative ovens. Components that remain substantially the same are basically provided with the same designations. Furthermore, in respect of features and functions that remain the same, one is referred to the description relating to the exemplary embodiment in FIGS. 1 to 3. The following description is restricted substantially to the differences from the exemplary embodiment in FIGS. 1 to 3.

The ovens have devices 18, 19 with swing-action closure device 26, 27. In the case of the oven in FIG. 4, an opening 16 corresponding to that in FIG. 1 is made in a sheet-metal base plate 34. In the case of the oven in FIG. 5, an opening 14 is made in a longitudinally oriented side of a sheet-metal plate 32A that, apart from the opening 14, is configured in a manner corresponding to the sheet-metal plate 32 in FIGS. 1 and 4. A sheet-metal base plate 34A, here, is configured without an opening for feeding extraneous air. The swing-action closure devices 26, 27 are each mounted through hinges 23, 24, which are disposed outside a channel 21 through which, in a manner corresponding to the exemplary embodiment in FIGS. 1 to 3, a vapor 13 can be removed. The closure device 26, 27 can be actuated through non-illustrated actuators.

We claim:

1. A cooker, comprising:

a feed device;

a cooking enclosure communicating with said feed device, said cooking enclosure defining:

a cooking space;

at least one vapor opening through which vapor produced during operation of the cooker can be fed as a vapor stream from said cooking space by said feed device; and at least one opening through which extraneous air can be taken in by said feed device; and an adjustment device adjusting a quantity of the extraneous air and, through the quantity of extraneous air, the vapor stream from said cooking space.

2. The cooker according to claim 1, wherein said at least one opening is disposed upstream of said feed device with respect to a flow direction.

3. The cooker according to claim 1, wherein said at least one opening is disposed upstream of said feed device with respect to a flow direction of the extraneous air.

4. The cooker according to claim 1, further comprising a channel adjoining said at least one vapor opening, said at least one opening being disposed in said channel between said at least one vapor opening and said feed device.

5. The cooker according to claim 4, wherein:

said channel has a dead space; and said at least one opening is disposed outside the vapor stream in said dead space.

6. The cooker according to claim 4, wherein:

said adjustment device has a moving device with least one guide element; and said least one guide element is disposed outside said channel.

7. The cooker according to claim 4, wherein:

said channel has at least one flow-deflector; and said at least one opening is disposed in a region of said flow-deflector in a direction downstream of said flow-deflector as viewed opposite the flow direction of the extraneous air.

8. The cooker according to claim 4, further comprising:

a further channel element disposed in said channel upstream of said opening as seen in a flow direction of the extraneous air; and a moveable portion of said adjustment device disposed upstream of said further channel element as seen in the flow direction of the extraneous air.

9. The cooker according to claim 8, wherein said further channel element is a component separate from said channel.

10. The cooker according to claim 4, wherein said channel has a labyrinth.

11. The cooker according to claim 1, wherein said adjustment device has at least one translationally displaceable closure.

12. The cooker according to claim 1, wherein said adjustment device has at least one closure guided to be displaced in a translatory manner.

13. The cooker according to claim 1, wherein said adjustment device has at least one actuator.

14. The cooker according to claim 13, further comprising a sensor unit for sensing at least one operating parameter of the oven, said actuator and said sensor unit automatically adjusting the vapor stream dependent upon the operating parameter.

15. The cooker according to claim 4, further comprising a catalyst disposed in said channel in a region of said vapor opening.

16. A cooker, comprising:

a feeding means;

a cooking enclosure communication with said feeding means, said cooking enclosure defining:

a cooking space;

at least one vapor opening through which vapor produced during operation of the cooker can be fed as a vapor stream from said cooking space by said feeding means; and at least one opening through which extraneous air can be taken in by said feeding means; and an adjustment device adjusting a quantity of the extraneous air and, through the quantity of extraneous air, the vapor stream from said cooking space.

17. A cooker, comprising:

a gas-feeding device; and a housing defining:

a cooking space fluidically connected to said gas-feeding device for supplying a gas at least to a portion of said cooking space;

at least one vapor opening through which vapor produced during operation of the cooker can be fed as a vapor stream from said cooking space by said gas-feeding device; and at least one opening through which air from the environment can be taken into said cooking space by said gas-feeding device; and an adjustment device fluidically connected to said cooking space and to said at least one opening for adjusting a quantity of the air and, dependent upon the quantity of air adjusted, for also adjusting a quantity of the vapor stream from said cooking space.

18. The cooker according to claim 17, wherein said gas-feeding device is an air-feeding device.

19. The cooker according to claim 4, wherein: said channel has at least one flow-deflector; and said at least one opening is disposed in a region of said flow-deflector in a direction downstream of said flow-deflector.

* * * * *